US011547189B1

(12) United States Patent
Barnes-Bauerle

(10) Patent No.: US 11,547,189 B1
(45) Date of Patent: Jan. 10, 2023

(54) SECURITY BAG WITH PRIVACY COVER

(71) Applicant: Leigh Ann Barnes-Bauerle, Watkinsville, GA (US)

(72) Inventor: Leigh Ann Barnes-Bauerle, Watkinsville, GA (US)

( * ) Notice: Subject to any disclaimer, the term of this patent is extended or adjusted under 35 U.S.C. 154(b) by 269 days.

(21) Appl. No.: 16/133,636

(22) Filed: Sep. 17, 2018

(51) Int. Cl.

| | |
|---|---|
| ***A45C 3/08*** | (2006.01) |
| ***A45C 1/02*** | (2006.01) |
| ***A45C 13/10*** | (2006.01) |
| ***A45C 13/12*** | (2006.01) |
| ***A45C 13/30*** | (2006.01) |

(52) U.S. Cl.
CPC ..... *A45C 3/08* (2013.01); *A45C 1/02* (2013.01); *A45C 13/103* (2013.01); *A45C 13/1092* (2013.01); *A45C 13/123* (2013.01); *A45C 13/30* (2013.01); *A45C 2013/1015* (2013.01); *A45C 2200/10* (2013.01)

(58) Field of Classification Search
CPC ..... A45C 3/08; A45C 1/02; A45C 13/103; A45C 13/1092; A45C 13/123; A45C 13/30; A45C 2013/1015; A45C 2200/10
See application file for complete search history.

(56) References Cited

U.S. PATENT DOCUMENTS 325,807 A * 9/1885 Adams ..... B65D 33/06 383/25
1,990,360 A * 2/1935 Anish ..... A45C 13/08 150/105
2,809,685 A 10/1957 Lowy
2,920,671 A * 1/1960 Siris ..... G09F 7/02 40/5
3,182,701 A 5/1965 Ginsburg
4,236,559 A * 12/1980 Archbold ..... A45C 3/00 224/610
4,907,633 A 3/1990 Eckstein
5,603,573 A * 2/1997 Mercier ..... A01K 1/0236 119/497
5,725,039 A 3/1998 Macinai et al.
6,231,233 B1 * 5/2001 Oree ..... A45C 13/08 150/101
6,394,157 B2 5/2002 Luna
6,543,499 B2 4/2003 McCreery
6,637,485 B1 * 10/2003 Sartena ..... A45C 3/06 150/101
6,923,302 B2 * 8/2005 Godshaw ..... A45C 3/00 190/109
7,028,730 B2 4/2006 Pace et al.
(Continued)

OTHER PUBLICATIONS

Amazon.com, Rough Enough bag , https://www.amazon.com/gp/product/B00KUHKFR6?pf_rd_r=X6MEG5TRNX67XSKSZ01C&pf_rd_p=edaba0ee-c2fe-4124-9f5d-b31d6b1bfbee, dated first available: Date First Available : May 7, 2015 (Year: 2015).*
(Continued)

*Primary Examiner* — Tri M Mai
(74) *Attorney, Agent, or Firm* — Smith Tempel Blaha LLC; Gregory Scott Smith

(57) ABSTRACT

A transparent bag suitable for carrying into venues holding out such security requirements and a cover that can be removeably secured to the bag to provide privacy and safety when the bag is not being inspected but that can be removed to facilitate bag inspections.

8 Claims, 8 Drawing Sheets

(56) References Cited

U.S. PATENT DOCUMENTS

| | | | | |
|---|---|---|---|---|
| 7,047,602 | B2 * | 5/2006 | Wang | A44B 19/262 24/429 |
| 7,059,371 | B2 | 6/2006 | Renn | |
| 7,222,649 | B1 * | 5/2007 | Fox | A45C 3/08 150/104 |
| 7,607,461 | B2 | 10/2009 | Pace et al. | |
| D610,801 | S | 3/2010 | Romero et al. | |
| D611,705 | S | 3/2010 | Romero et al. | |
| D613,062 | S | 4/2010 | Romero et al. | |
| 7,789,114 | B2 | 9/2010 | Pace et al. | |
| D636,988 | S | 5/2011 | Romero et al. | |
| D637,399 | S | 5/2011 | Romero et al. | |
| D637,810 | S | 5/2011 | Romero et al. | |
| D638,627 | S | 5/2011 | Romero et al. | |
| D639,551 | S | 6/2011 | Romero et al. | |
| D640,871 | S | 7/2011 | Romero et al. | |
| 8,156,974 | B2 | 4/2012 | Pace et al. | |
| 8,179,255 | B1 | 5/2012 | Lamore et al. | |
| D665,176 | S | 8/2012 | Platt et al. | |
| 8,684,053 | B2 | 4/2014 | Platt et al. | |
| 8,684,054 | B2 | 4/2014 | Platt et al. | |
| 8,925,181 | B2 | 1/2015 | Godshaw et al. | |
| 9,198,489 | B2 | 12/2015 | Romero et al. | |
| 9,486,047 | B2 | 11/2016 | GOdsahw et al. | |
| 9,622,559 | B2 | 4/2017 | Pace et al. | |
| 9,655,424 | B2 | 5/2017 | Godshaw et al. | |
| 9,687,054 | B2 | 6/2017 | Platt et al. | |
| 2003/0177664 | A1 * | 9/2003 | Monassebian | A45C 3/08 36/100 |
| 2007/0102077 | A1 | 5/2007 | Parker-Ogden | |
| 2007/0163689 | A1 | 7/2007 | Pace et al. | |
| 2013/0037185 | A1 * | 2/2013 | Hubbell | A45C 13/42 150/106 |
| 2015/0000805 | A1 * | 1/2015 | Whitaker | A45C 3/08 150/105 |

OTHER PUBLICATIONS

Amaro: https://www.youtube.com/watch?v=rzS6pHTEY3s, dated Aug. 31, 2017, by Amaro Bags Store LBP (Year: 2017).*

* cited by examiner

SECURITY BAG WITH PRIVACY COVER

BACKGROUND

Around the year 2016, a wave began to flow across our country that was striking at popular venues and events. Over a short period of time, it has almost become a universal standard in large sporting and entertainment events. This wave is known in sporting world as the "game-day bag" requirement but, it is also known as "clear bag" and "security bag" requirements.

As is usually the case, a few incidents gave rise to a security concern, and as the old adage goes, necessity is the mother of invention. To help provide security and safety in largely populated event venues, this wave of requiring "game-day bags" or clear bags began to rise in popularity. Before requiring patrons to carry a clear bag into a venue, security guards were required to open a bag, stick their hands into the bag and move items around, take items out, etc. to adequately confirm that prohibited items were not being brought into the venue. As one can imagine, this activity can feel like a huge breach of privacy to the patron, and can be quite uncomfortable for the security guard—never knowing what he or she may stick their hands into. However, with the requirement that patrons carry a security bag into a venue, the time to inspect the bags has been decreased, the quality of the inspections greatly increased, as well as other benefits have been realized.

But the reader will appreciate that most security measures come at a cost. This cost is usually in the form of a loss or privacy and/or freedom. With the implementation of clear bag policies, this is also the case. With all of your personal belongings clearly visible to people in your immediate vicinity, it is easier for thieves to target bags that will have a great yield. For instance, a thief can easily see if there is a significant amount of money, an expensive phone, valuable jewelry, a money holder or other things of value by conducting a quick scan. In addition, it is often that people need to carry items that are quite necessary but also quite personal. With a clear bag policy, an individual's privacy is easily compromised in such situations.

Thus, there is a need in the art for a technique to provide the security and safety measures attained by clear bag policies but, to still maintain a level of privacy and freedom for individuals carrying a clear bag. The present disclosure describes various embodiments of a solution to this need in the art, as well as other needs.

BRIEF SUMMARY

The present invention, as well as features and aspects thereof, is directed towards a security or safety bag, purse or container that includes a detachable and removable privacy cover. More specifically, the various embodiments of the present invention include a container that is constructed of at least one panel made from a transparent material and then reinforced with an opaque material along the edges of the panels where they are connected together and optionally a panel made from an opaque material.

DETAILED DESCRIPTION OF VARIOUS EMBODIMENTS

The present invention, as well as features and aspects thereof, is directed towards a security or safety bag, purse or container that includes a detachable and removable privacy cover. More specifically, the various embodiments of the present invention include a container that is constructed of at least one panel made from a transparent material and optionally a panel made from an opaque material and then reinforced with an opaque material along the edges of the panels where they are connected together. The various aspects, features and elements of the various embodiments are better understood by examining the figures, in which like labels refer to like elements throughout the various views.

Figure 1:
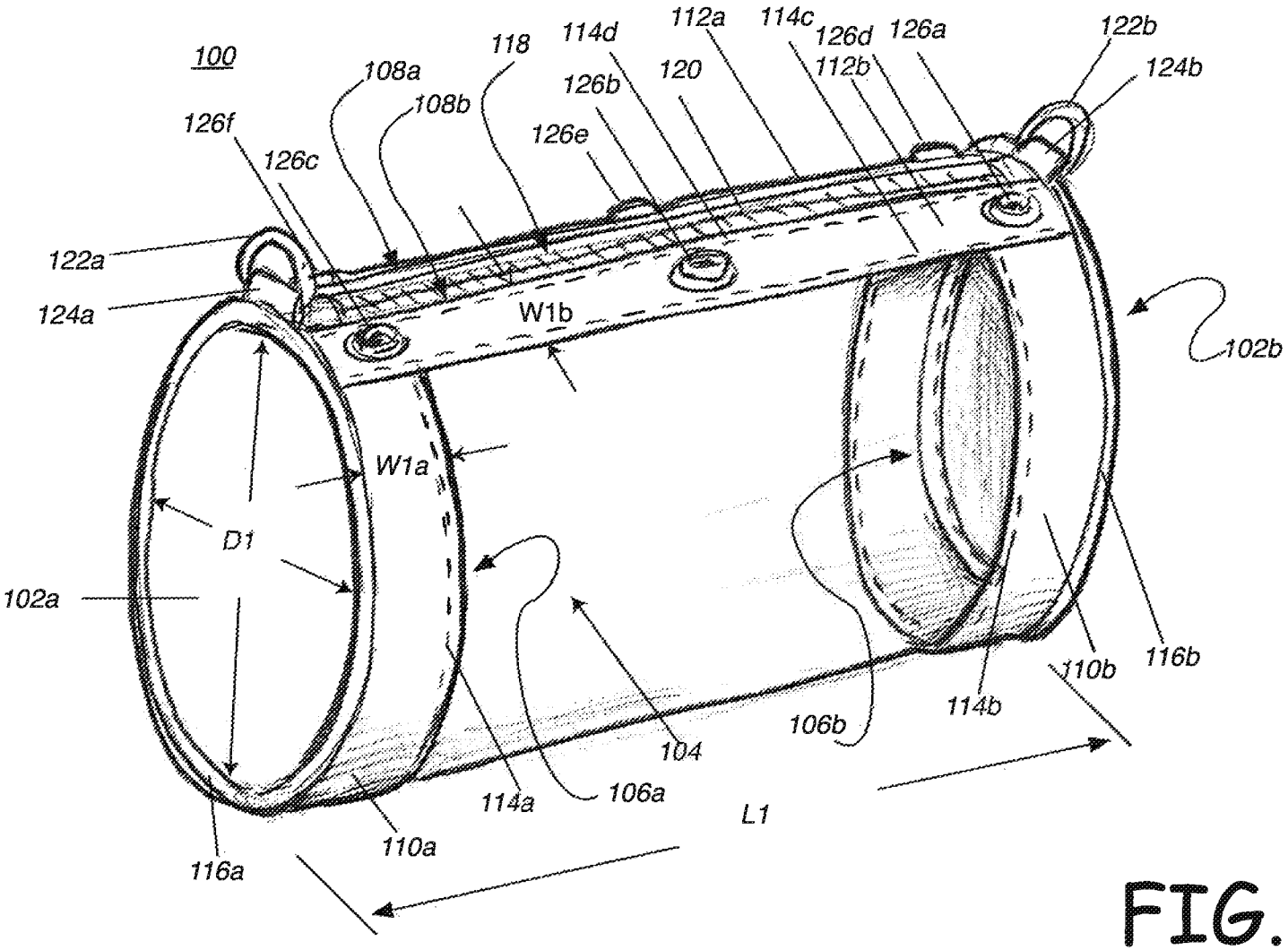
FIG. 1, is a rendering of an embodiment of a container that is suitable for use in an embodiment of the present invention, wherein the container is illustrated as being in the shape of a barrel.

FIG. 1, is a rendering of an embodiment of a container that is suitable for use in an embodiment of the present invention, wherein the container is illustrated as being in the shape of a barrel. In the illustrated embodiment, the container 100 includes a first side panel 102*a* and a second side panel 102*b* that are substantially parallel to each other and define opposing ends of the barrel container 100. The body or body panel 104 of the barrel container 100 is formed by a panel that is made from a transparent material.

It should be appreciated that in one embodiment, the first side panel 102*a* and the second side panel 102*b* are a leather material, however, it will be appreciated that these panels could be constructed of any of a variety of materials including plastics, cloths, woven and non-woven materials, silicon and other flexible materials as well as non-flexible materials such as woods, plastics, metals, composite materials and metal alloys as a few non-limiting examples. Further, in the various embodiments the first side panel 102*a* and/or the second side panel 102*b* may be transparent, translucent or opaque. In the illustrated embodiment, the first side panel 102*a* and the second side panel 102*b* are illustrated as being circular with a diameter of D1, however, in other embodiments, the first side panel 102*a* and the second side panel 102*b* may be oval, egg-shaped, rectangular, square, triangular, trapezoidal and gum-drop-shaped as a few non-limiting examples.

It should also be appreciated that the body panel 104 can be made of a soft malleable plastic, a semi-rigid plastic or a rigid plastic as long as the material is transparent. In some embodiments the body panel 104 may be slightly tinted or tinted but not to an extent that it would obstruct the view of the container interior.

The body panel 104, when deconstructed and laid flat, is in the shape of a rectangle and thus, the body panel 104 includes a first edge 106*a* and a second edge 106*b* that are on opposing sides of the rectangle and which are substantially parallel to each other. The body panel 104 also includes a first end edge 108*a* and a second end edge 108*b*, which are also on opposing ends of the rectangle and substantially parallel to each other. The first edge 106*a*, the second edge 106*b*, the first end edge 108*a* and the second end edge 108*b* are not fully visible in the drawing because the view is obstructed by other material. The length of the body panel 104 from the first edge 106*a* to the second edge 106*b* is L1. In some embodiments L1 is 8 inches, in other embodiments L1 can range from 6 to 10 inches, in other embodiments, L1 can extend over even a wider range.

The borders of the body panel 104 are trimmed and thus, the entire perimeter of the body panel 104 is trimmed with the first edge 106*a* being trimmed by material 110*a*, the second edge 106*b* being trimmed by material 110*b*, the first end edge 108*a* being trimmed by material 112*a* and the second end edge 108*b* being trimmed by material 112*b*. In the illustrated embodiment, the trim is shown as having the width dimension of W1*a* for side trims 110*a* and 110*b*, and the width dimension W1*b* for the ends 112*a* and 112*b*. In an exemplary embodiment, W1*a* and W1*b* are ¾ of an inch, however, this measurement can range from zero inches to 1 inch or even more in some embodiments.

In some embodiments, the trim is applied to the body panel 104 by folding a material over the edge of the body panel 104 such that a substantially even amount of material is on both faces of the body panel 104, and then stitching through the outside trim, body panel 104 and underside trim as shown with stitching 114*a*, 114*b*, 114*c* and 114*d*.

Figure 8:
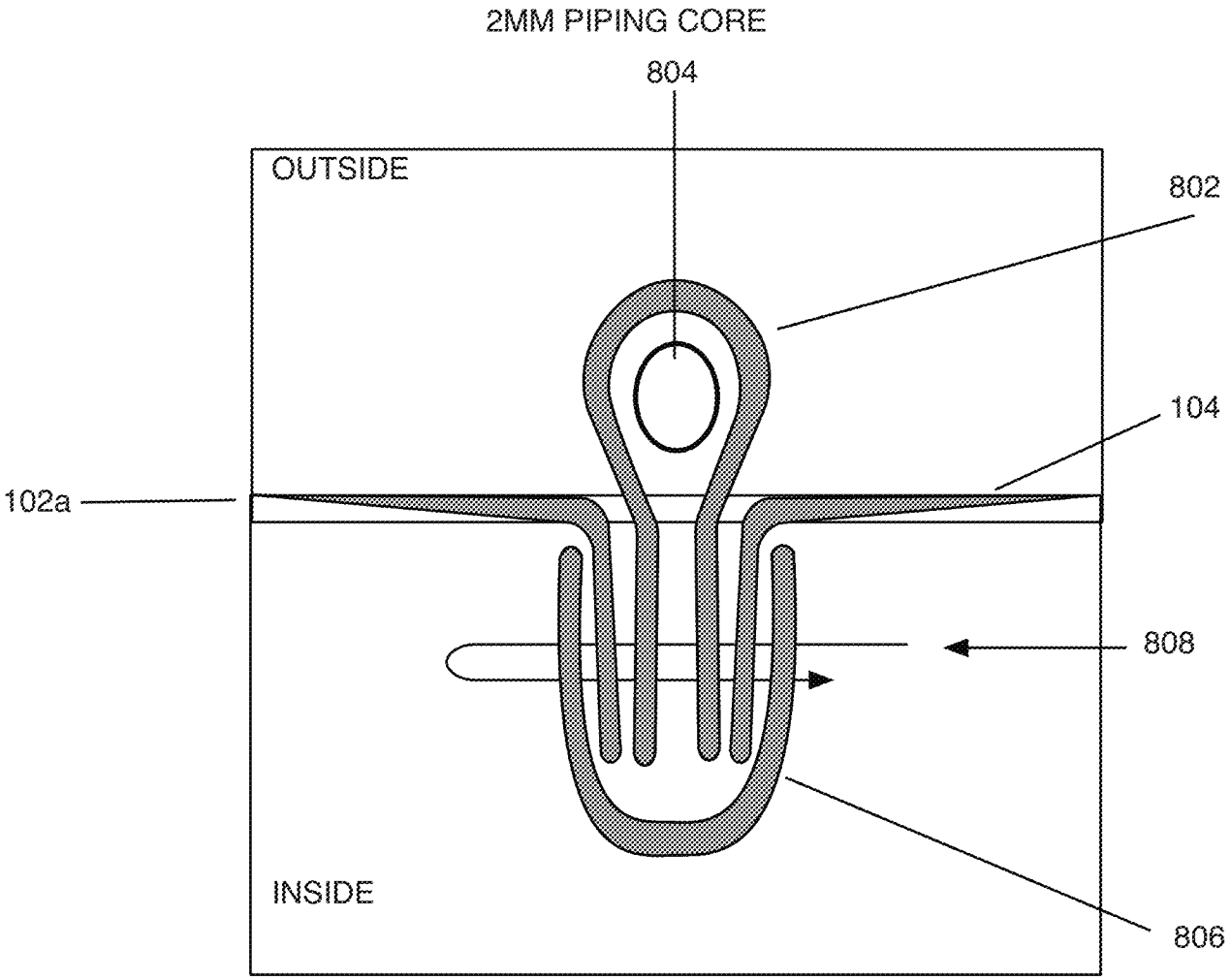
FIG. 8 is an illustration of one method for mounting materials or panels together in the various embodiments of the security container.

FIG. 8 is an illustration of one method for mounting materials or panels together in the various embodiments of the security container. As a non-limiting example of the operation of this construct, two pieces of body material, such as the body panel 104 and the first side panel 102*a* are joined together by folding a piping material 802 around a piping core 804 and aligning the edges of the piping material with the edges of body panel 104 and first side panel 102*a* to be joined together and then encompassing the ends within a binding 806 and then running stitching through the binding 806, body panel 104 (with trim) piping 802, first side panel 102*a*, the other end of binding 806 and then back through 808. The piping core 804 is positioned such that it will be visible on the outside of the container and the binding 806 will be within the interior.

By using the technique illustrated in FIG. 8, or some other technique, the body panel 104 is joined to the first side panel 102*a* and the second side panel 102*b* to form the barrel container 100. The piping 116*a* is between the first side panel 102*a* and the body panel 104, and the piping 116*b* is between the second side panel 102*b* and the body panel 104.

The first and second end edges (108*a* and 108*b*) of the body panel 104 are thus held in proximity to each other and together, they define the perimeter of an opening 118 to provide access into an interior area or void that is defined by the inner surfaces of the body panel and the first side panel 102*a* and the second side panel 102*b*. In the illustrated embodiment, a zipper 120 is shown as a sealing mechanism for securing the opening 118 into a closed state or allowing the opening to be placed into an open state. However, it should be appreciated that in various embodiments, other techniques such as snaps, buttons, VELCRO or other loop and hook material, tie string, magnets, clasps, and spring or snap strips as a few non-limiting examples may be used to secure the opening or, in other embodiments, the opening may be left open and nothing is used to secure it into a closed position.

It should be appreciated that the illustrated embodiment allows the ease of viewing of any items that are placed within the interior of the container, which it the illustrated embodiment can be a handbag or purse. In addition, the container includes two rings or D-rings 122*a* and 122*b* that are adjoined to the container 100 by looped straps 124*a* and 124*b* respectively. As such, a strap, similar to the strap illustrated in FIG. 3A-3E, can be connected to the rings 122*a* and 122*b* for carrying the container over ones shoulder or in the hands.

In the illustrated embodiment, the container 100 is also illustrated as including a cover receptor interface positioned on an outside surface of the container 100 in proximity with and along a length of the perimeter edge of opening 118. In the illustrated embodiment, the cover receptor interface consists of a plurality of snaps 126*a-f* that are positioned along the perimeter edge of the opening with three snaps being located on each side of the opening 118.

Figure 2:
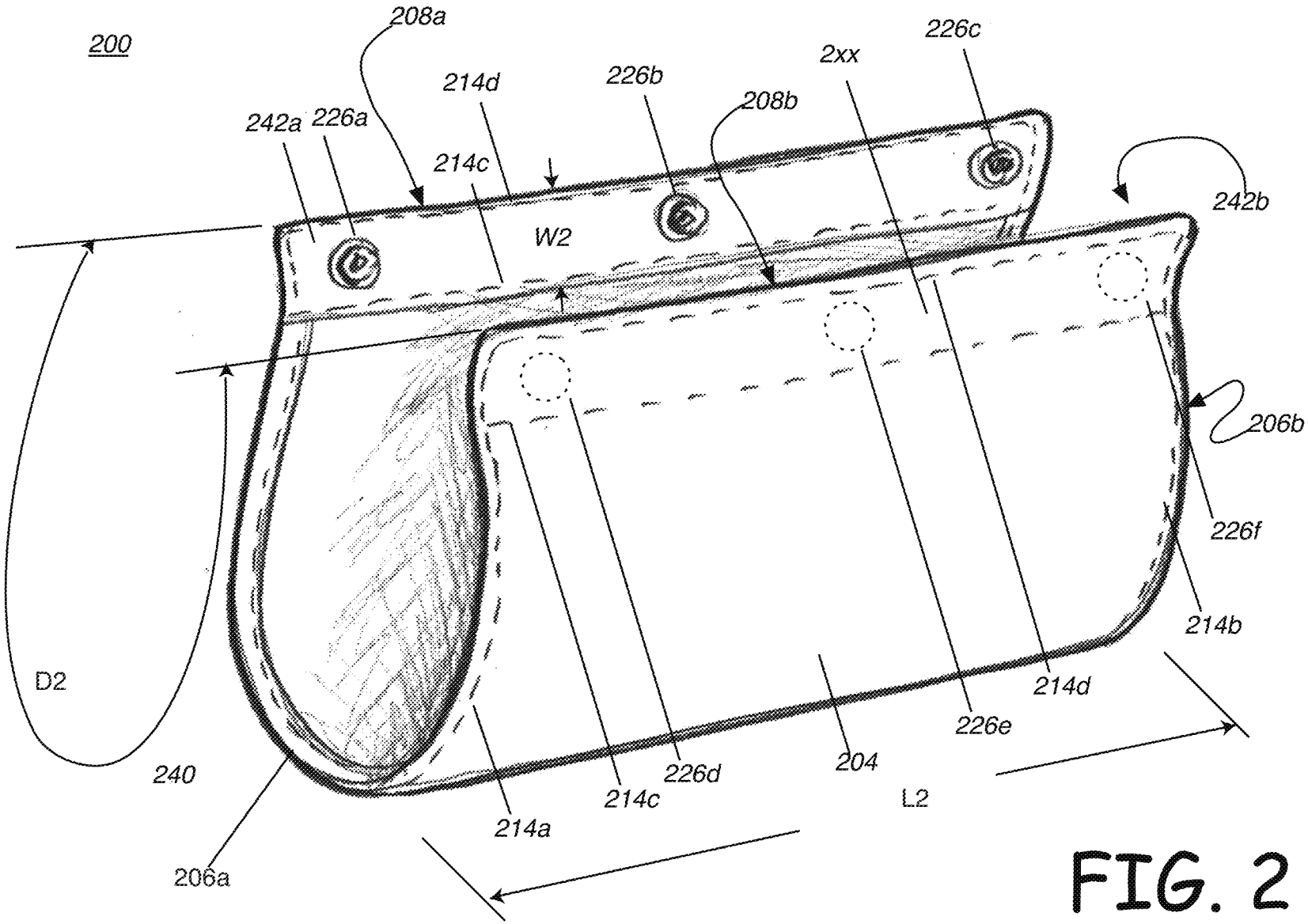
FIG. 2 is a rendering of an embodiment of a container cover that is suitable for use with the container illustrated in FIG. 1.

FIG. 2 is a rendering of an embodiment of a container cover that is suitable for use with the container illustrated in FIG. 1. In the illustrated embodiment, the container cover 200 consist of a single panel 202, which in the illustrated embodiment, is rectangular in shape. The single panel 202 includes a first side edge 206*a* and a second side edge 206*b* that are located on opposing sides of the rectangular shape and are substantially parallel to each other. In addition, the single panel 202 includes a first end 208*a* and a second end 208*b* that are also located on opposing sides of the rectangular shape and are substantially parallel to each other and are substantially perpendicular to the first side edge 206*a* and the second side edge 206*b*. The first side edge 206*a* and the second side edge 206*b* are formed by folding a portion of the edges over and then stitching through the fold with stitching 214*a* and 214*b* respectively. Further, the first end edge 208*a* and the second end edge 208*b* are also formed by folding the edge under itself and stitching the fold with stitching 214*c* and 214*d*. In the illustrated embodiment, the fold for the first end edge 208*a* and the second end edge 208*b* has a width of W2. In an exemplary embodiment W2 is about 1 inch but in other embodiments, W2 may be larger or smaller than 1 inch.

The interior surface 240 of the single panel 202 of the container cover 200 includes a connector interface region 242*a* and 242*b*, respectively associated with first end edge 208*a* and second end edge 208*b* that house the connector interface. In the illustrated embodiment, the connector interface includes snaps 226*a-c* illustrated in connector interface region 242*a* and three additional snaps in connector interface region 204*b* (not shown but illustrated by dotted lines as 226*d-f*).

The length of the single panel 202 extending from the first side edge 206*a* to the second side edge 206*b* is L2. In an exemplary embodiment, L2 is approximately 8 inches, in another embodiment, L2 can range from about 6 to 10 inches. In yet other embodiments, L2 can vary over a wider range. In exemplary embodiments, L2 should approximately be the same as L1 in FIG. 1 but, with the trimming, it is acceptable for L2 to be less than L1. In addition, in some embodiments, the first side edge 206*a* and the second side edge 206*b* may protrude inward so as to secure the single panel 202 around the edges of the barrel container 100. In such embodiments, L2 should be slightly larger than L1.

In addition, the distance between the first end edge 208*a* and the second end edge 208*b* is D2. D2 should be of sufficient length to allow the connector interface of the container cover to mate with the cover receptor interface 126*a-e* of the container 100. In an exemplary embodiment, D2 is 13 and ⅜ inches. In other embodiments, D2 may be larger or smaller than 13 and ⅜ inches depending on the size of the barrel container 100.

In the illustrated embodiment, the connector interface includes snaps that mate with the snaps located in the cover receptor interface. However, it should be appreciated that rather than snaps, other techniques may be used to secure the container cover 200 to the container, including techniques such as buttons, VELCRO or other loop and hook material, tie string, magnets, clasps, collar pins and spring or snap strips as a few non-limiting examples.

Figures 3A, 3B, 3C, 3D, 3E:
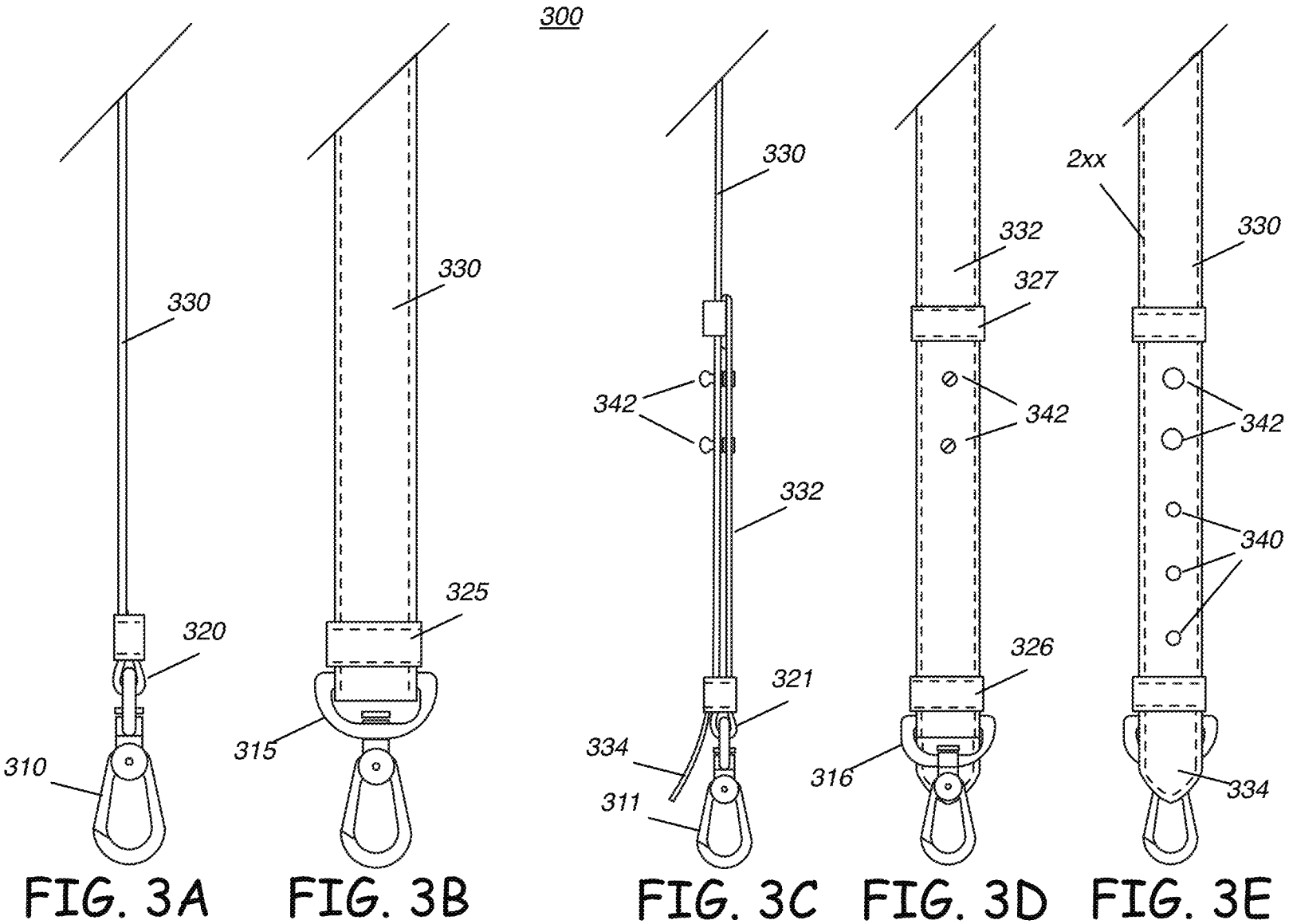
FIG. 3A is a side-view rendering of a first end of a strap that is suitable for use with the various embodiments of the present invention.
FIG. 3B is a front-view rendering of a first end of a strap that is suitable for use with the various embodiments of the present invention.
FIG. 3C is a side-view rendering of a second end of a strap that is suitable for use with the various embodiments of the present invention.
FIG. 3D is a front-view rendering of a second end of a strap that is suitable for use with the various embodiments of the present invention.
FIG. 3E is a back-view rendering of a second end of a strap that is suitable for use with the various embodiments of the present invention.

FIGS. 3A-3E, which collectively may be referred to as FIG. 3, illustrate several views of an exemplary strap that may be used on various embodiments of the present invention.

FIG. 3A is a side-view rendering of a first end of a strap that is suitable for use with the various embodiments of the present invention. FIG. 3B is a front-view rendering of a first end of a strap that is suitable for use with the various embodiments of the present invention. This end of the strap 300 includes a connector 310 that includes a D-Ring type connection 315 to the strap 300. The strap 300 includes a loop 320 that is looped around the flat end of the D-Ring 315 and then sewed onto itself to fixedly attach the connector 310 to the strap 300. A decorate loop 325 can be used to conceal the connection point of the loop 320.

FIG. 3C is a side-view rendering of a second end of a strap that is suitable for use with the various embodiments of the present invention. FIG. 3D is a front-view rendering of a second end of a strap that is suitable for use with the various embodiments of the present invention. FIG. 3E is a back-view rendering of a second end of a strap that is suitable for use with the various embodiments of the present invention. On the second end of the strap, a similar connector 311 is included with D-Ring 316. Again, loop 321 is used to fixedly attach the connector 311 to the strap and loop 326 is used to conceal the stitching for loop 321. It should be noted that the strap 300 includes a first strap 330 depicted in FIG. 3A, FIG. 3B FIG. 3C and FIG. 3E, and a second strap 332 depicted in FIG. 3C and FIG. 3D. The first strap 330 has an end point 334. Strap 330 is fed through loops 326 and 327. The first strap includes a plurality of apertures 340 and the second strap 332 includes a plurality of pins, connector or collar pins 342. The apertures 340 of the first strap can receive the collar pins 342 to secure the first strap 330 and the second strap 332 to each other and, having multiple apertures 340 allows for the length of the strap 300 to be adjusted.

Figure 4A:
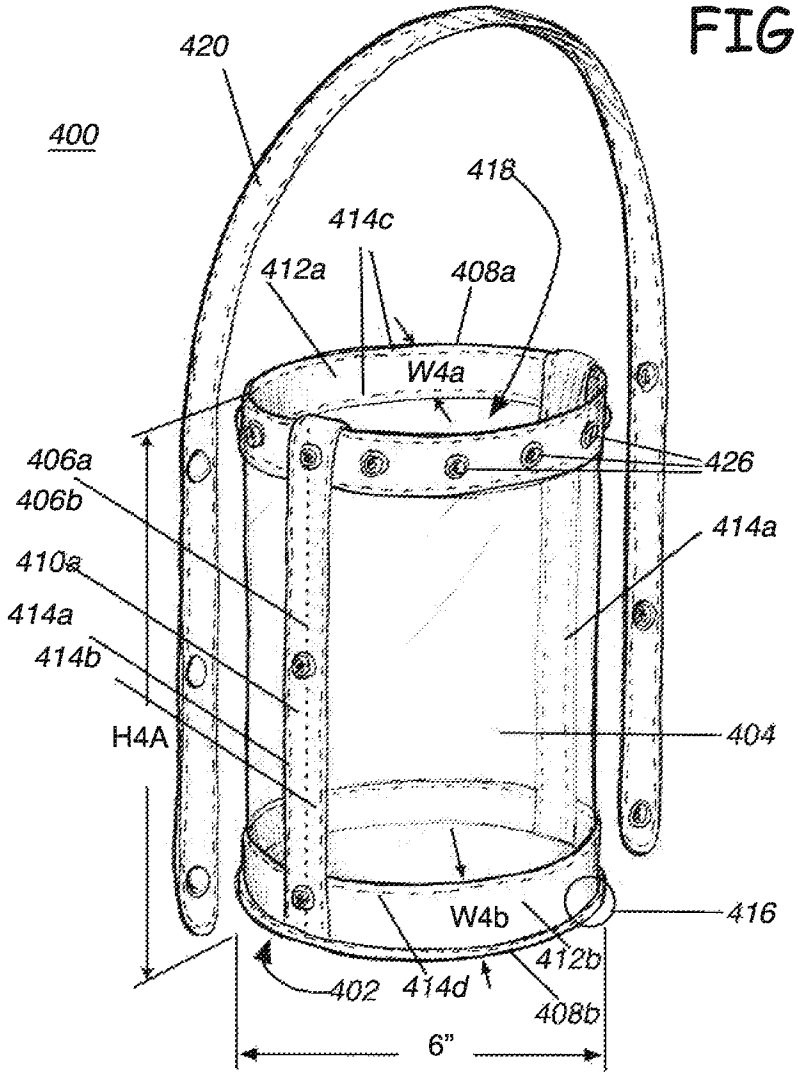
FIG. 4A, is a rendering of an embodiment of a container that is suitable for use in an embodiment of the present invention, wherein the container is illustrated as being in the shape of a bucket.

FIG. 4A, is a rendering of an embodiment of a container that is suitable for use in an embodiment of the present invention, wherein the container is illustrated as being in the shape of a bucket. In the illustrated embodiment, the container 400 includes a bottom panel 402 and a body panel 404. The body or body panel 404 of the bucket container 400 is formed by a single panel that is made from a transparent material but, could also be formed from multiple panels as well.

It should be appreciated that in one embodiment, the bottom panel 402 is constructed out of a leather material, however, it will be appreciated that these panels could be constructed of any of a variety of materials including plastics, cloths, woven and non-woven materials, silicon and other flexible materials as well as non-flexible materials such as woods, plastics, metals, composite materials and metal alloys as a few non-limiting examples. Further, in the various embodiments the bottom panel may be transparent, translucent or opaque. In the illustrated embodiment, the bottom panel 402 is illustrated as being circular with a diameter of D4, however, in other embodiments, the bottom panel 402 may be oval, egg-shaped, rectangular, square, triangular, trapezoidal and gum-drop-shaped as a few non-limiting examples. In an exemplary embodiment D4 is about 6 inches, but in other embodiments D4 may range from 4 to 10 inches, and in other embodiments D4 may vary over a wider range.

It should also be appreciated that the body panel 404 can be made of a soft malleable plastic, a semi-rigid plastic or a rigid plastic as long as the material is transparent. In some embodiments the body panel 404 may be slightly tinted or tinted but not to an extent that it would obstruct the view of the container interior.

The body panel 404, when deconstructed and laid flat, is in the shape of a rectangle and thus, the body panel 404 includes a first edge 406*a* and a second edge 406*b* that are on opposing sides of the rectangle and which are substantially parallel to each other. The body panel 404 also includes a top edge 408*a* and a bottom edge 408*b*, which are also on opposing ends of the rectangle and substantially parallel to each other. The first edge 406*a*, the second edge 406*b*, the top edge 408*a* and the bottom edge 408*b* are not fully visible in the drawing because the view is obstructed by other material. The height of the body panel 404 from the top edge 408*a* to the bottom edge 408*b* is H4. In some embodiments H4 is 8.5 inches, in other embodiments H4 can range from 6 to 10 inches, in other embodiments, H4 can extend over even a wider range.

The borders of the body panel 404 are trimmed and thus, the entire perimeter of the body panel 404 is trimmed. To form the bucket container, the first edge 406*a* is brought into contact with the second edge 406*b* thus forming a cylinder. The abutted first edge 406*b* and second edge 406*b* are trimmed by material 410*a* and the abutment is illustrated as a broken line running vertically in the middle of trip material 410. In some embodiments, such as the illustrated embodiment, a second trimming 410*b* can be applied to the opposing side of the cylinder from the trim 410*a* to create symmetry. In yet other embodiments, it should be appreciated that the body panel 404 can consist of two panels that are joined together under the trip 410*a* and 410*b*. The top edge 408*a* is trimmed by material 412*a* and the bottom edge 408*b* is trimmed by material 412*b*. In the illustrated embodiment, the trim at the top edge 408*a* is shown as having the width dimension of W4*a*, and the width dimension W4*b* for the bottom end 408*b*. In an exemplary embodiment, W4*a* and W4*b* are 1 inch, however, this measurement can range from zero inches to 1 inch or even more in some embodiments and in some embodiments the width W4*a* may be larger or smaller than the width W4*b*.

In some embodiments, the trim is applied to the body panel 404 by folding a material over the edge of the body panel 404 such that a substantially even amount of material is on both faces of the body panel 404, and then stitching through the outside trim, body panel 404 and underside trim as shown with stitching 414*a*, 414*b*, 414*c* and 414*d*.

Similar to the description of the embodiment of FIG. 1 and FIG. 2, FIG. 8 is an illustration of one method for mounting materials or panels together in the various embodiments of the bucket security container 400 as well.

By using the technique illustrated in FIG. 8, or some other technique, the body panel 404 is joined to the bottom panel 402 to form the bucket container 400. The piping 416 is applied between the bottom panel 402 and the body panel 404.

The top edge 408*a*, thus defines the perimeter of an opening 418 to provide access into an interior area or void that is defined by the inner surfaces of the body panel 404 and the bottom panel 402. In some embodiments, a rigid ring can be included within the trip 412*a* to help provide strength to the opening but in other embodiments, the opening is left flexible so that it can be closed and secured into a closed state or allowing the opening to be placed into an open state. It should be appreciated that in various embodiments, various techniques can be used for securing the opening 418 in a closed state, such as snaps, buttons, VELCRO or other loop and hook material, tie string, magnets, zippers, clasps, collar pins and spring or snap strips as a few non-limiting examples may be used to secure the opening or, in other embodiments, the opening may be left open and nothing is used to secure it into a closed position.

It should be appreciated that the illustrated embodiment allows the ease of viewing of any items that are placed within the interior of the container, which in the illustrated embodiment can be a handbag or purse. In addition, the container may include two rings or D-rings similar to the barrel container 100 illustrated in FIG. 1 to receive a strap. As such, a strap, similar to the strap illustrated in FIG. 3A-3E, can be connected to the rings for carrying the bucket container 400 over one's shoulder or in the hands. However, as is illustrated in FIG. 4A, the trim areas 414*a* and 414*b* can include a plurality of snaps and the strap 420 can include corresponding mating snaps and thus allow the strap to be snapped into place. In some embodiments that strap can be of adjustable length.

In the illustrated embodiment, the container 400 is also illustrated as including a cover receptor interface positioned on an outside surface of the container 400 in proximity with and along a length of the perimeter edge of opening 418. In the illustrated embodiment, the cover receptor interface consists of a plurality of snaps 426 that are positioned along the perimeter edge of the opening 418.

Figure 4B:
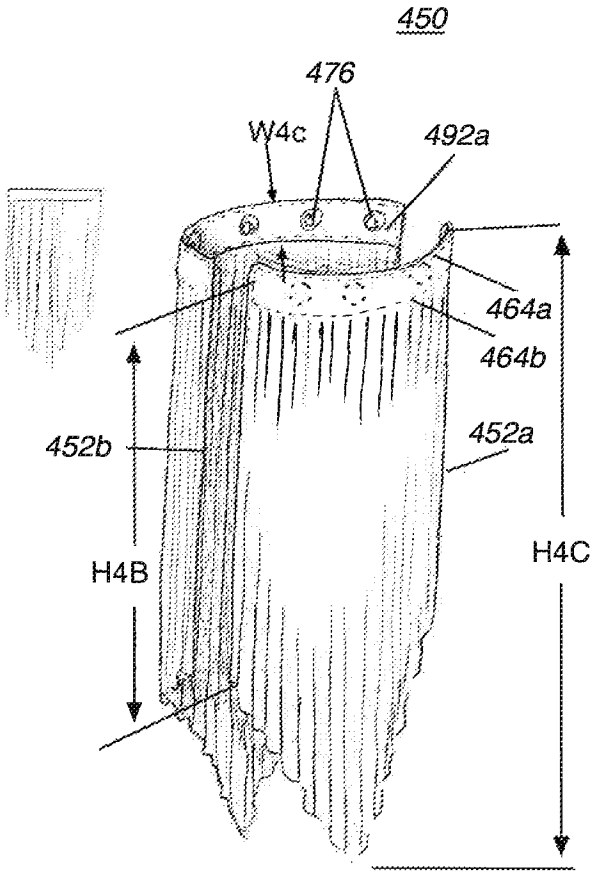
FIG. 4B is a rendering of an embodiment of a container cover that is suitable for use with the container illustrated in FIG. 4A.

FIG. 4B is a rendering of an embodiment of a container cover that is suitable for use with the container illustrated in FIG. 4A. In the illustrated embodiment, the container cover 450 consist of two panels 452*a* and 452*b*, which in the illustrated embodiment, includes a scalloped fringe design. However, it should be appreciated that in some embodiments, a single panel can be used or more than 2 panels could be used. In addition, the panels may be rectangular, or include a rounded bottom, or other styles. The illustrated panels 452*a* and 452*b* include a top edge 458*a* and 458*b* respectively. The top edges 458*a* and 458*b* are formed by folding a portion of the edges of the respective panels over and then stitching through the fold with stitching 264*a* and 264*b* respectively. In the illustrated embodiment, the fold for the top edges 408*a* and 408*b* have a width of W4*c*. In an exemplary embodiment W4*c* is about 1 inch but in other embodiments, W4*c* may be larger or smaller than 1 inch.

The interior surface 490*a* and 490*b* of the single panel 452*a* and 452*b* respectively of the container cover 400 includes a connector interface region 492*a* and 492*b* (not shown), respectively associated with top edge 408 of the container 400 that houses the cover receptor interface. In the illustrated embodiment, the connector interface includes snaps 476 illustrated in connector interface region 492*a* and three additional snaps in connector interface region 492*b* (not shown but illustrated by dotted lines).

The height of the panels 452*a* and 452*b* vary with the scalloped edge but in the illustrated embodiment, the length of the panel or drape ranges from H4B to H4C. In an exemplary embodiment, H4B is approximately 8.5 inches and H4C is approximately 10.5 inches. In another embodiments, H4B and H4C can be the same value and have a length of a wider range. In exemplary embodiments, H4B and H4C should approximately be the same or greater than H4A in FIG. 4A but, with the trimming, it is acceptable for H4B and H4C to be less than H4A.

In the illustrated embodiment, the connector interface includes snaps that mate with the snaps located in the cover receptor interface. However, it should be appreciated that rather than snaps, other techniques may be used to secure the container cover 200 to the container, including techniques such as buttons, VELCRO or other loop and hook material, tie string, magnets, clasps, collar pins and spring or snap strips as a few non-limiting examples. It should also be appreciated that a cover similar to the rectangular cover illustrated in FIG. 2 could also be used for the bucket container 400. For instance, another cover connecter interface could be positioned along the bottom of the bucket container.

Figure 5B:
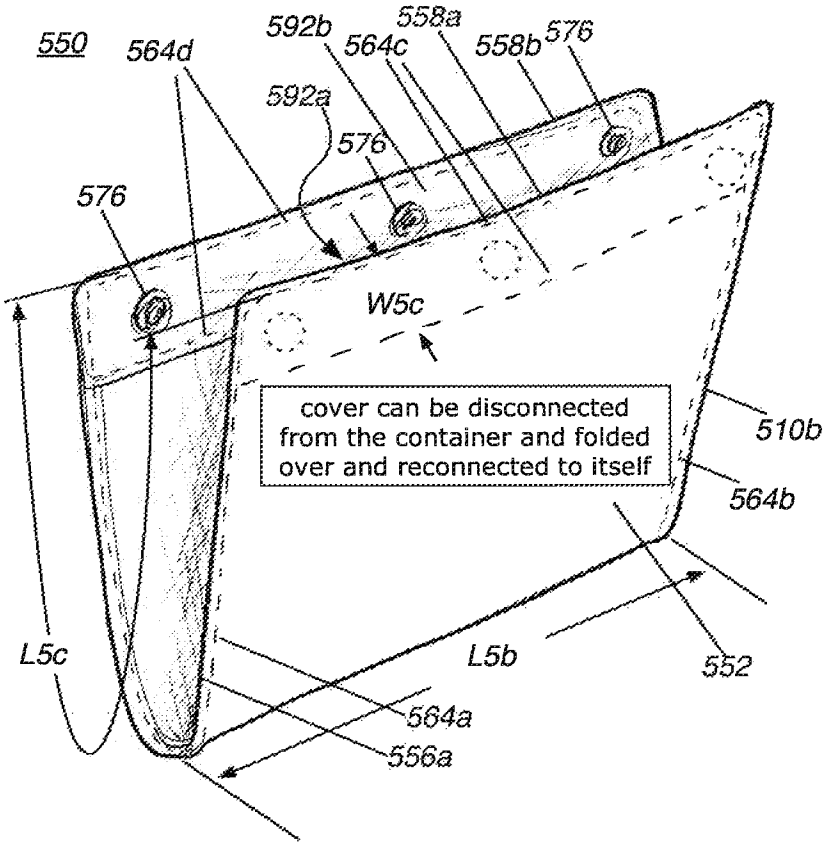
FIG. 5B is a rendering of an embodiment of a container cover that is suitable for use with the container illustrated in FIG. 5A.
Figure 5A:
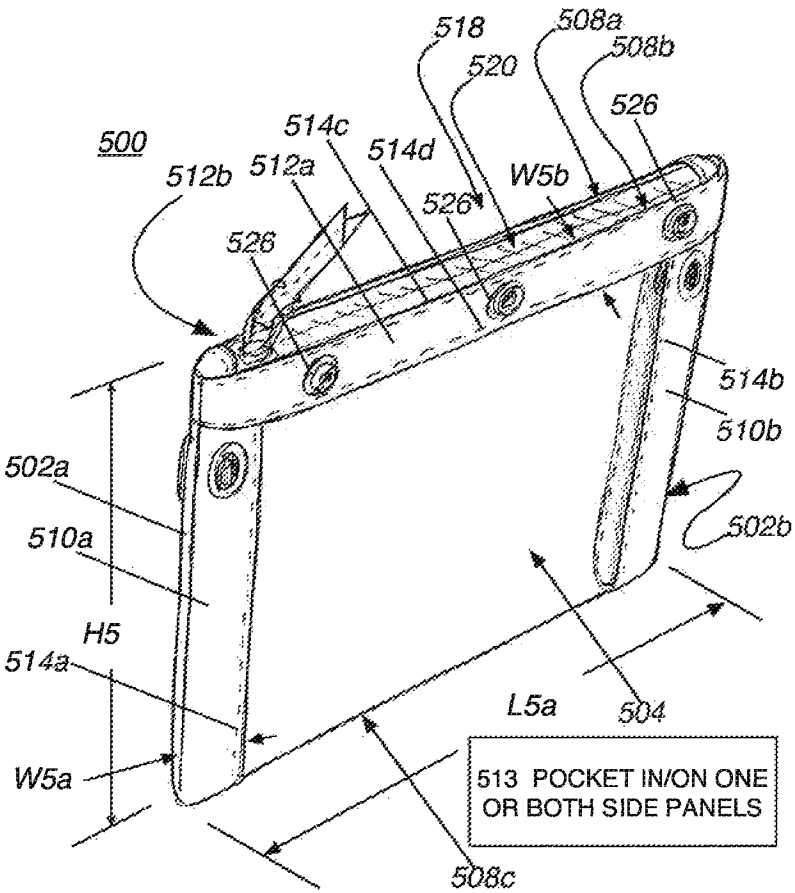
FIG. 5A, is a rendering of an embodiment of a container that is suitable for use in an embodiment of the present invention, wherein the container is illustrated as being in the shape of a rectangle.

FIG. 5A, is a rendering of an embodiment of a container that is suitable for use in an embodiment of the present invention, wherein the container is illustrated as being in the shape of a rectangle, or an envelope. In the illustrated embodiment, the container 500 includes a first side edge 502*a* and a second side panel 502*b* that are substantially parallel to each other and define opposing ends of the envelope container 500. The body of the envelope container 500 is formed by a panel 504 that is made from a transparent material.

It should be appreciated that in some embodiments, the body panel 504 can be made of a soft malleable plastic, a semi-rigid plastic or a rigid plastic as long as the material is transparent. In some embodiments the body panel 504 may be slightly tinted or tinted but not to an extent that it would obstruct the view of the container interior.

The body panel 504, when deconstructed and laid flat, is in the shape of a rectangle and thus, the body panel 504 includes the first side edge 502*a* and a second side edge 502*b* that are on opposing sides of the rectangle and which are substantially parallel to each other. The body panel 504 also includes a first end edge 508*a* and a second end edge 508*b*, which are also on opposing ends of the rectangle and substantially parallel to each other. The first side edge 502*a*, the second side edge 502*b*, the first end edge 508*a* and the second end edge 508*b* are not fully visible in the drawing because the view is obstructed by other material. The length of the body panel 504 from the first side edge 506*a* to the second side edge 506*b* is L5*a*. In some embodiments L5*a* is 9 inches, in other embodiments L5*a* can range from 7 to 11 inches, in other embodiments, L5*a* can extend over even a wider range. Further, when the body panel 504 is folded to make the container, the height of the container is H5. In an exemplary embodiment, H5 is 5 and ¾ inches, but in some embodiments, H5 may range from 4.5 inches to 7 inches, and in other embodiments the range of H5 may be even wider.

The borders of the body panel 504 are trimmed and thus, the entire perimeter of the body panel 504 is trimmed with the first edge 502*a* being trimmed by material 510*a*, the second edge 502*b* being trimmed by material 510*b*, the first end edge 508*a* being trimmed by material 512*a* and the second end edge 508*b* being trimmed by material 512*b* (not shown). In the illustrated embodiment, the trim is shown as having the width dimension of W1*a* for side trims 510*a* and 510*b*, and the width dimension W5*b* for the ends 512*a* and 512*b*. In an exemplary embodiment, W5*a* and W5*b* are ¾ of an inch, however, this measurement can range from zero inches to 1 inch or even more in some embodiments. Further, in some embodiments, the measurements of W5*a* and W5*b* may be different from each other.

In some embodiments, the trim is applied to the body panel 504 by folding a material over the edge of the body panel 504 such that a substantially even amount of material is on both faces of the body panel 504, and then stitching through the outside trim, body panel 504 and underside trim as shown with stitching 514*a*, 514*b*, 514*c* and 514*d*.

It should be appreciated that in one embodiment, the trim can be constructed out of a leather material, however, it will be appreciated that these panels could be constructed of any of a variety of materials including plastics, cloths, woven and non-woven materials, silicon and other flexible materials as well as non-flexible materials such as woods, plastics, metals, composite materials and metal alloys as a few non-limiting examples. Further, in the various embodiments the trim may be transparent, translucent or opaque.

In constructing the container 500, the trimmed panel 504 is folded along a middle line 508*c* such that the first side edge 502*a* and the second side edge 502*b* are folded over themselves and the first and second end edges (508*a* and 108*b*) of the body panel 504 are held in proximity to each other. The first and second end edges (508*a* and 508*b*) define the perimeter of an opening 518 to provide access into an interior area or void that is defined by the inner surfaces of the body panel 504. In the illustrated embodiment, a zipper 520 is shown as a sealing mechanism for securing the opening 518 into a closed state or allowing the opening to be placed into an open state. However, it should be appreciated that in various embodiments, other techniques such as snaps, buttons, VELCRO or other loop and hook material, tie string, magnets, clasps, and spring or snap strips as a few non-limiting examples may be used to secure the opening or, in other embodiments, the opening may be left open and nothing is used to secure it into a closed position.

It should be appreciated that the illustrated embodiment allows the ease of viewing of any items that are placed within the interior of the container 500, which in the illustrated embodiment can be a handbag or purse. In addition, the container may include one or more rings or connectors, such as two D-rings that can adjoined to the container 500 by looped straps or otherwise. As such, a strap, similar to the strap illustrated in FIG. 3A-3E, can be connected to the D-rings carrying the container 500 over one's shoulder or in the hands.

In the illustrated embodiment, the container 500 is also illustrated as including a cover receptor interface positioned on an outside surface of the container 500 in proximity with and along a length of the perimeter edge of opening 518. In the illustrated embodiment, the cover receptor interface consists of a plurality of snaps 526 that are positioned along the perimeter edge 518 of the opening 520. In the illustrated embodiment, there are three snaps being located on each side of the opening 518, thus three snaps on trip 512*a* and three snaps on trip 512*b*. In some embodiments, the cover receptor interface may include in addition to or in lieu of the snaps on the perimeter edge 518, snaps on one or more sides of the first side edge trip 510*a* and the second side edge grim 510*b*.

FIG. 5B is a rendering of an embodiment of a container cover that is suitable for use with the envelope container 500 illustrated in FIG. 5A. In the illustrated embodiment, the container cover 550 consist of a single panel 552, which in the illustrated embodiment, is rectangular in shape if it were to be laid out flat. The single panel 552 includes a first side edge 556*a* and a second side edge 556*b* that are located on opposing sides of the rectangular shape and are substantially parallel to each other. In addition, the single panel 552 includes a first end 558*a* and a second end 558*b* that are also located on opposing sides of the rectangular shape and are substantially parallel to each other and are substantially perpendicular to the first side edge 556*a* and the second side edge 556*b*. The first side edge 556*a* and the second side edge 556*b* are formed by folding a portion of the edges over and then stitching through the fold with stitching 564*a* and 564*b* respectively. Further, the first end edge 558*a* and the second end edge 558*b* are also formed by folding the edge under itself and stitching the fold with stitching 564*c* and 564*d*. In the illustrated embodiment, the fold for the first end edge 558*a* and the second end edge 558*b* has a width of W5*c*. In an exemplary embodiment W5*c* is about 1 inch but in other embodiments, W5*c* may be larger or smaller than 1 inch.

It should also be appreciated that in some embodiments, the cover 552 may simply be a flat material without any folded over edges. For instance, if the cover 552 is constructed of silicone, plastic or other similar materials. Further, in some embodiments, the cover 552 may be one material that is trimmed, similar to the panel 504, on one or more edges by the same or a different material. For instance, the cover 552 may be canvas and be trimmed in leather as a non-limiting example. This also applies to the other embodiments described herein as well as other embodiments not specifically presented herein.

The interior surface 590 of the single panel 552 of the container cover 500 includes a connector interface region 592*a* and 592*b*, respectively associated with first end edge 558*a* and second end edge 558*b* that house the connector interface. In the illustrated embodiment, the connector interface includes snaps 576 illustrated in connector interface region 592*a* and three additional snaps in connector interface region 592*b* (not shown but illustrated by dotted lines).

The length of the single panel 552 extending from the first side edge 556*a* to the second side edge 556*b* is L5*b*. In an exemplary embodiment, L5*b* is approximately 9 inches, in another embodiment, L5*b* can range from about 7 to 11 inches. In yet other embodiments, L5*b* can vary over a wider range. In exemplary embodiments, L5*b* should approximately be the same as L5*a* in FIG. 5A but, with the trimming, it is acceptable for L5*b* to be less than L5*a*.

In addition, the distance between the first end edge 558*a* and the second end edge 558*b* is L5*c*. L5*c* should be of sufficient length to allow the connector interface of the container cover 552 to mate with the cover receptor interface 526 of the container 500. In an exemplary embodiment, L5*c* is 12¾ inches. In other embodiments, L5*c* may be larger or smaller than 12¾ inches depending on the size of the envelope container 500.

In the illustrated embodiment, the connector interface includes snaps that mate with the snaps located in the cover receptor interface. However, it should be appreciated that rather than snaps, other techniques may be used to secure the container cover 552 to the container 500, including techniques such as buttons, VELCRO or other loop and hook material, tie string, magnets, clasps, collar pins and spring or snap strips as a few non-limiting examples.

It will be appreciated that each of the three specific embodiments presented herein, the barrel container, the bucket container and the envelope container are just non-limiting examples of a few embodiments of the present invention. In addition, the dimensions recited herein are also non-limiting examples. It should also be appreciated that the various embodiments, such as the barrel container, bucket container and/or envelope container can be dimensioned such that the covers are interchangeable between the various containers. As a non-limiting example, the three illustrated containers could be manufactured to match the following measurements:

Barrel Container 100—the length L1 of the barrel container 100 could be 9 inches and the length of cover 200 could be 9 inches by 13⅜ inches (with the 13⅜ inches approximating the circumference around the barrel container 100;

Bucket Container 400—the length L5*a* of the envelope container 500 could be 9 inches and the length height of the envelope H5 could be the circumference of the bucket container 300 could be 13⅜ inches (or 26 and ¾ inches) and the height H4A could be 9 inches; and Envelope Container 500—the length L5*a* of the envelop container 500 could be 9 inches. and the height H5 of the envelope container 500 could be 6.5 inches.

Using these measurements, a cover that is 9 inches by 13⅜ inches could be used to cover the barrel container 100, the 13⅜ inch circumference bucket container 400 and the envelope container 500. Likewise, a 26 and ¾ inch circumference bucket container 400 could be configured to be covered with two such covers. In such embodiments, a kit can be sold with multiple containers and multiple covers and the user can mix and match covers and containers to match outfits, moods or needs.

In some embodiments, a pocket 513 is included in or on the container for holding one or more covers. For instance, in the barrel container 100, a pocket may be included in one or both of the side panel 102*a* and 102*b*. These pockets may hold one or more covers 200. Thus, the owner can remove the cover and place it within the pocket when going through security. In addition, the owner can carry one or more extra covers to change the look of the bag if so desired. Similarly, the bucket container 400 may include a pocket underneath the bottom of the bucket. Finally, the envelope container 500 may include an interior or exterior pocket on one or more of the panels. It should be appreciated that a pocket 513 can be formed in the transparent panels, such as the envelope container 500, the bucket container 400 and the barrel container 100 for housing one or more covers. In addition, the covers can also be configured to connect back onto themselves so that half of the cover can be disconnected from the container, and then folded over and reconnected to itself to allow security personnel to see into the container.

Figure 6B:
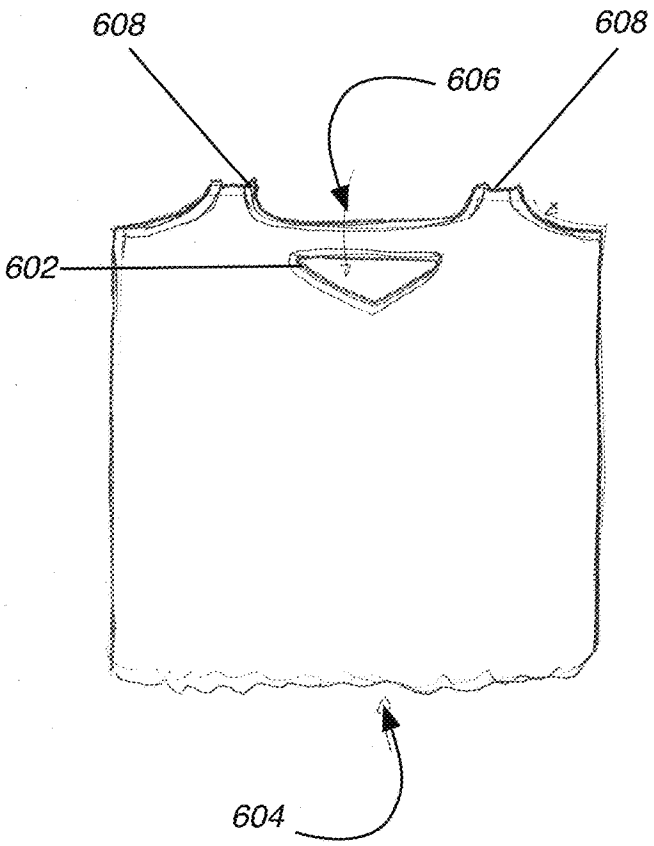
FIG. 6B is a front view of the tote cover of FIG. 6A.
Figure 6A:
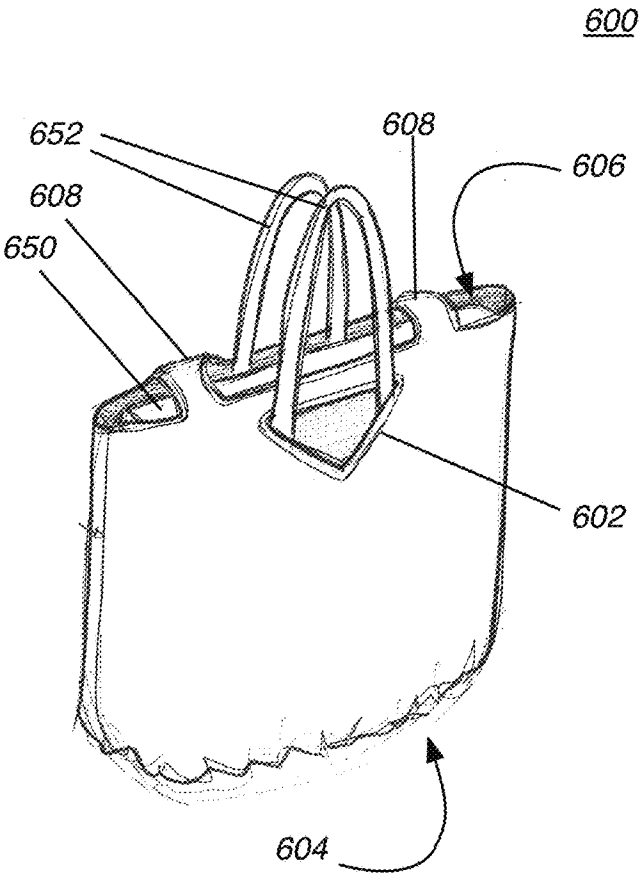
FIG. 6A is a perspective view of a tote cover for a security tote bag.

FIG. 6A is a perspective view of a tote cover for a security tote bag. FIG. 6B is a front view of the tote cover of FIG. 6A. Generally, a tote bag is square or rectangular in shape and has two looping handles connected to both sides of the top. As illustrated in FIGS. 6A and 6B, a tote cover 600 is used to cover and conceal the contents within a security or game day tote back that is constructed with transparent panels, or any other tote as well. The tote cover includes two apertures 602, one on each side of the cover (only one is visible in the illustration). The tote cover 600 includes a bottom opening 604. The bottom opening 604 may include elastic to help close the bottom opening 604 around the bottom of the tote 650, or the bottom opening 604 may include another mechanism, such as snaps, a zipper, VELCRO or other hook and loop material, magnets, buttons, tie string as a few non-limiting examples. The handles 652 of the tote 650 are inserted up through the bottom opening 604 and through the two apertures 602 and the bottom opening 604 can be cinched to keep the tote 650 inside. It should be appreciated that in some embodiments, the bottom opening 604 may be replaced by a side opening or even the top opening can be configured to receive the tote 650. For instance, as illustrated, a tote 650 can be folded and slid inside the top opening 606 and then unfolded inside and the handles 652 pulled through the apertures 602. In yet other embodiments, the straps 608 can be detachable on one or more sides to allow a tote 650 to be inserted into the cover 600 while full and without having to fold the tote 650.

Figure 7B:
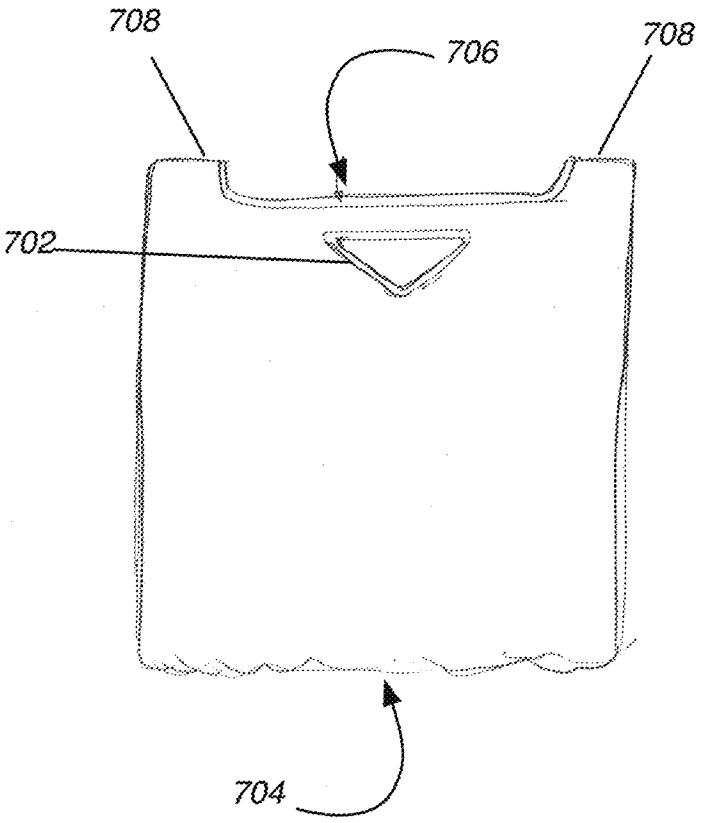
FIG. 7B is a front view of the tote cover of FIG. 7A.
Figure 7A:
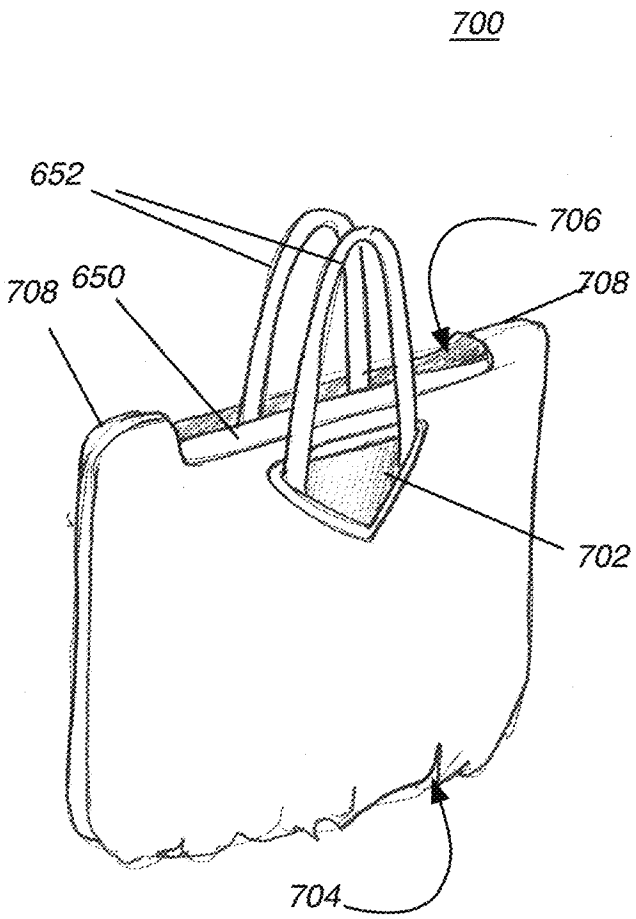
FIG. 7A is a perspective view of another embodiment of a tote cover for a security tote bag.

FIG. 7A is a perspective view of another embodiment of a tote cover for a security tote bag. FIG. 7B is a front view of the tote cover of FIG. 7A. In the illustrated embodiment, a single opening is included in the top, whereas the embodiment of FIG. 6A and FIG. 6B included three openings. As illustrated in FIGS. 7A and 7B, a tote cover 700 is used to cover and conceal the contents within a security or game day tote bag that is constructed with transparent panels, or any other tote as well. The tote cover includes two apertures 702, one on each side of the cover (only one is visible in the illustration). The tote cover 700 includes a bottom opening 704. The bottom opening 704 may include elastic to help close the bottom opening 704 around the bottom of the tote 750, or the bottom opening 704 may include another mechanism, such as snaps, a zipper, VELCRO or other hook and loop material, magnets, buttons, tie string as a few non-limiting examples. The handles 752 of the tote 750 are inserted up through the bottom opening 704 and through the two apertures 702 and the bottom opening 704 can be cinched to keep the tote 750 inside. It should be appreciated that in some embodiments, the bottom opening 704 may be replaced by a side opening or even the top opening can be configured to receive the tote 750. For instance, as illustrated, a tote 750 can be folded and slid inside the top opening 706 and then unfolded inside and the handles 752 pulled through the apertures 702. In yet other embodiments, the straps 708 can be detachable on one or more sides to allow a tote 750 to be inserted into the cover 700 while full and without having to fold the tote 750.

In any of the described embodiments, a whistle is optionally attached to the side, a ring or a zipper of the security bag to identify a branding of the bag as well as to provide an alerting mechanism in an emergency situation. The whistle gives easy access to the owner to draw attention if the owner believes that he or she may be at risk or in danger.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. An apparatus comprising:

a container comprising:

a single rectangular shaped panel constructed of a transparent material and including a first edge and a second edge that are parallel to each other and a third edge and a fourth edge that are parallel to each other and are perpendicular to the first edge and the second edge;

an opaque material border secured to the first edge, second edge, third edge and fourth edge of the single rectangular shaped panel;

the single rectangular shaped panel being folded along a center line that is parallel and mid-point between the first edge and the second edge and that is perpendicular to the third edge and the fourth edge with a first half of the third edge being adjoined to a second half of the third edge and a first half of the fourth edge being adjoined to a second half of the fourth, to define a void within the interior of the container that is visible from either side of the container;

the first edge and the second edge defining a main opening for providing access to the void of the container; and a cover receptor interface positioned on an outside surface of the container in proximity with and along a length of at least the first edge and the second edge;

a pocket attached to the single rectangular shaped panel; and a container cover comprising:

a cover panel constructed from an opaque material and having an inside surface and an outside surface;

a connector interface located along at least two edges of the inside surface of the cover panel, the connector interface corresponding with the cover receptor interface of the container;

wherein the cover panel has dimensions that ensure that the single rectangular shaped panel constructed of a transparent material is fully covered when the connector interface of the container cover is adjoined to the cover receptor interface of the container; and wherein the container cover is fully detachable from the container and wherein the fully detached container cover can be placed into the pocket or, one side of the container cover can be detached while leaving the other side of the container cover attached and wherein the container cover includes a second connector interface located along the least two edges of the outside surface of the cover panel, wherein one edge of the cover panel can be disconnected from the container and folded back onto itself to be connected to the other edge of the cover panel.

2. The apparatus of claim 1, wherein the first edge and a second edge and the container further comprise a sealing structure that includes a first element located on the first edge a second element located on the second edge with the first element including a mechanism to be detachably secured to the second element thereby allowing the main opening to transition between a closed state when attached and an open state when detached.

3. The apparatus of claim 2, wherein the cover receptor interface includes a first cover receptor interface that is positioned on the first edge and a second cover receptor interface that is position on the second edge.

4. The apparatus of claim 3, wherein the connector interface of the container cover further comprises a first connector interface and a second connector interface, and wherein the first connector interface mates with the first cover receptor interface and the second connector interface mates with the second cover receptor interface to position and secure the container cover over the at least one transparent material panel, whereby any contents within the container cannot be viewed from the outside.

5. The apparatus of claim 1, wherein the pocket is located within the void.

6. The apparatus of claim 1, wherein the pocket is located on the exterior of the container.

7. The apparatus of claim 1, wherein the cover panel is constructed of canvas with leather borders.

8. The apparatus of claim 7, wherein the leather borders are sufficiently rigid to maintain position and covering of the single rectangular panel.

* * * * *